United States Patent [19]

Dien

[11] Patent Number: 4,520,855

[45] Date of Patent: Jun. 4, 1985

[54] GOLF CLUB COVER

[76] Inventor: Sam Dien, 156 Rockwood Pl., Englewood, N.J. 07631

[21] Appl. No.: 565,457

[22] Filed: Dec. 27, 1983

[51] Int. Cl.[3] ..... A63B 57/00

[52] U.S. Cl. ..... 150/52 G; 206/315.4

[58] Field of Search ..... 150/52 G; 206/315.2, 206/315.4; 40/915

[56] References Cited

U.S. PATENT DOCUMENTS

| | | | |
|---|---|---|---|
| 2,110,122 | 3/1938 | Burgett | 150/52 G |
| 3,128,812 | 4/1964 | Scheurer | 150/52 G X |
| 3,294,138 | 12/1966 | Pawly | 150/52 G |
| 3,295,236 | 1/1967 | Wishnia | 150/52 G X |
| 3,603,368 | 9/1971 | Brenner | 150/52 G |
| 3,638,284 | 2/1972 | Baker | 150/52 G |
| 4,164,969 | 8/1979 | Dien | 150/52 G |
| 4,296,787 | 10/1981 | Barton | 150/52 G |

FOREIGN PATENT DOCUMENTS

| | | | |
|---|---|---|---|
| 974912 | 11/1964 | United Kingdom | 150/52 G |

*Primary Examiner*—William Price
*Assistant Examiner*—Sue A. Weaver
*Attorney, Agent, or Firm*—Hopgood, Calimafde, Kalil, Blaustein & Judlowe

[57] ABSTRACT

An improved golf club cover includes a first member attached to the golf club cover, to which either the male or female portion of a snap fastener is secured. Also secured to the body of the golf club cover is a second attachment member which includes a mating portion of a snap fastener so as to permit one cover removed from a club in use to be detachably secured to another cover, such as one placed over a club not then in use. If desired, a mating snap portion may also be provided on the golf bag to allow the free cover to be detachably secured to the golf bag.

4 Claims, 5 Drawing Figures

GOLF CLUB COVER

The present invention relates generally to golf accessories, and more particularly to an improved design of a golf club cover.

It is a common practice for golfers to place a protective cover over the heads of at least some of their golf clubs, usually the woods, for decorative purposes and also to protect the club heads against the environment and from being scraped or scratched. When a golfer uses a club to make a golf shot he or she must remove the club from the golf bag and remove the cover from the club. After the golf shot is made, the club is restored to the bag and the previously removed cover is replaced over the head of the club.

The problem has heretofore been in the golfer's knowing what to do with the removed or free golf club cover while he or she makes the golf shot. Many players place the free cover in their back pocket, whereas others throw the cover on the ground. The former practice can and often does result in the back pocket being torn or in the cover falling out of the player's pocket. The latter practice often results in the cover being forgotten and lost after the club is used, and may, particularly when the ground is wet, result in damage to or soiling of the cover. This procedure may also result in a delay of play caused by a player returning to the location of an eariler golf shot to retrieve a forgotten club cover lying on the ground.

It is an object of the present invention to provide an improved golf club cover, which substantially reduces the likelihood of loss of the cover during play.

It is another object of the present invention to provide a means to more conveniently handle a golf club cover during the time it is removed from a golf club.

To these ends, the present invention provides an improved golf club cover which includes a first attachment member secured to the body of the golf club cover. The first attachment member carries either the male or female portion of a snap fastener. Also secured to the body of the golf club cover is an a second attachment member which includes a mating portion of a snap fastener so as to permit a cover removed from a club to be detachably secured to another cover such as one placed over a club not then in use. If desired, an additional mating snap fastener may also be provided on the golf bag to allow the free golf club cover to be detachably secured to the golf bag.

To the accomplishment of the above and such further objects as may hereinafter appear, the present invention relates to an improved golf club cover substantially as defined in the appended claims and as described in the following detailed specication of an embodiment of the invention, considered together with the accompanying drawings in which:

Figure 1:
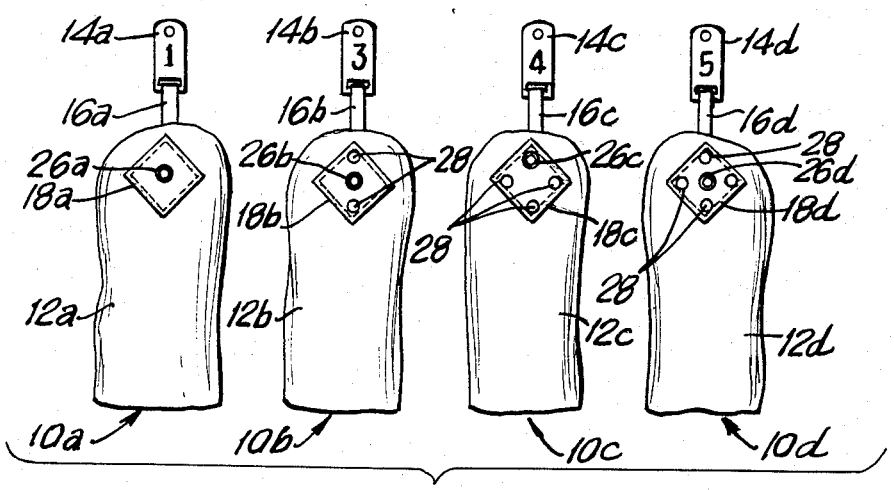
FIG. 1 is an illustration of a group of golf club covers incorporating features of the present invention.

The golf club cover of the invention, as in the embodiment shown in FIG. 1, in which four golf club covers generally designated 10*a*, 10*b*, 10*c* and 10*d* are shown, includes, as is conventional, a body portion 12 which is typically of a shape to conform to the head of the golf club which it is adapted to cover. The body portion 12 may be made of any suitable, durable material such as vinyl, wool, cloth or leather. When the club whose head is covered by the golf club cover is not being used by the golfer, the club typically is contained within a golf bag with the cover placed over the head of the club. When the club is to be used to make a golf shot, the club is removed from the golf bag and the cover is removed from the head of the club.

The present invention provides a way to secure the removed or free golf club cover to another golf club cover, preferably one which is placed over the head of a club contained within the golf bag, so that the free cover will not be lost or forgotten and can be readily retrieved once its associated golf club is returned to the bag. To this end, the golf club cover 10 includes a first attachment member 14 (FIGS. 2 and 3) which, as shown in FIG. 1, is connected to the body portion 12 by means of a flexible strap or strip 16, and a second attachment portion 18 (FIG. 4) which, as shown in FIGS. 1 and 4, may be in the form of a patch secured to the body portion as by sewing.

Figure 2:
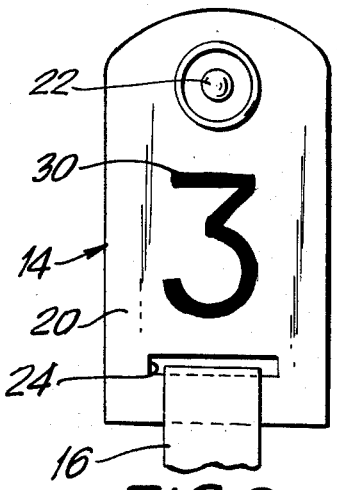
FIG. 2 is a front view, on an enlarged scale as compared to FIG. 1, of one of the attachment members of the golf club cover of the invention.
Figure 3:
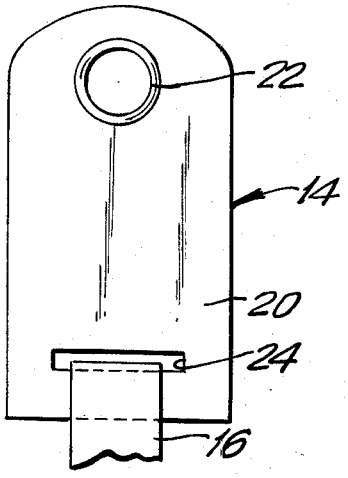
FIG. 3 is a view of the reverse side of the attachment member of FIG. 2.

As seen best in FIGS. 2 and 3, the first attachment portion 14 may consist essentially of a rigid disc 20 made, for example, of plastic to which is secured either a male or female type of snap fastener 22, the male type being shown in FIGS. 2 and 3. A rectangular slot 24 is formed in the lower half of the disc 20 to allow one end of flexible strap or strip 16 to pass therethrough.

Figure 4:
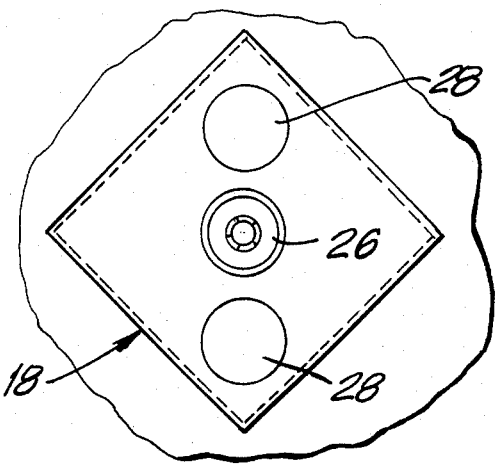
FIG. 4 is an illustration of the other attachment member of the golf club cover of the invention.

The second attachment member 18, as shown in FIG. 4, may be diamond-shaped and may include a snap-type fastener 26, which is here shown as the female-type fastener adapted to mate with the male-type snap fastener 22 on attachment member 14. The second attachment member 18, as also shown in FIG. 4 as well as in FIG. 1, may also include a plurality of caps, the number of which when added to the single member constituting the snap fastener 26 is equal to the number assigned to identify the club over which the cover is placed. That club number may also be presented, as at 30, on the attachment member 14. As shown in FIG. 1, the additional caps 28 may either surround snap fastener 26, as on covers 10*b* and 10*d*, or form a diamond with the snap fastener 26, as in cover 10*c*. In this way, the player by counting the number of elements secured to the attachment member 26, can readily identify the number of the club from which the club cover was removed or over which the cover is to be placed when the club is returned to the bag.

In use, when one of the covers 10 is removed from the head of a club to allow the player to use the golf club to make a golf shot, the free cover is secured to another cover, which remains over another golf club contained in the bag, by inserting the male snap fastener 22 of the first attachment member 14 of the free cover to the female snap fastener 26 of the second attachment member on the other golf club cover. After the golf shot is made the player releases the snap-fit attachment between these two golf club covers and replaces the free cover on the club just used, which is thereafter returned to the bag. In this manner, the free golf club cover cannot be misplaced or dropped on the golf course and need not be stuffed into the player's pocket.

Figure 5:
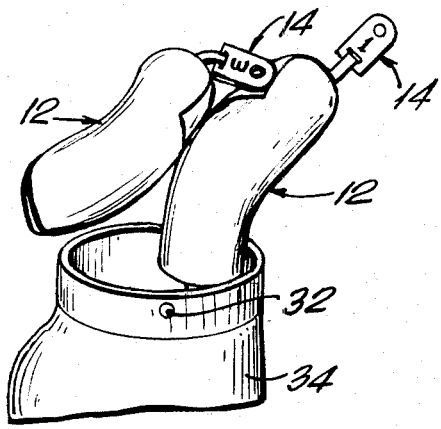
FIG. 5 illustrates the upper end of a golf bag illustrating how the golf club cover may be attached to the bag while the associated club is in use.

In an alternative or supplemental attachment arrangement, as shown in FIG. 5, an additional snap fastener 32 may be provided on the top cuff of a golf bag 34, to mate with the snap fastener 22 of the free golf club cover while the associated cover is being used.

It will thus be appreciated that the golf club cover of the present invention provides an effective means for ensuring that a removed cover can be readily and removably secured to a fixed object, such as another club cover or to the golf bag. In this manner the likelihood that the cover will be lost, forgotten or damaged will be substantially reduced. It will also be appreciated that whereas the invention has been described with respect to a single embodiment, variations and modifications may be made therein, such as in the configuration of the attaching members, without necessarily departing from the spirit and scope of the invention.

What is claimed is:

1. A golf club cover arrangement comprising at least two golf club covers, each of said golf club covers including a body portion shaped and adapted to fit over the head of a golf club, a first and a second attachment member secured to said body portion, first and second mating fastening means respectively secured to said first and second attachment members, whereby one of said fastening means on one of said said first and second attachment members on one golf club cover removed from a golf club can be detachably secured to the mating fastening means on the other of said first and second attachment members of another golf club cover, and one or more caps provided on said second attachment member and positioned in proximity to said second fastening means, the number of said caps being less by one the identifying number of the golf club over which the cover is adapted to be placed when the club is not in use.

2. The golf club cover of claim 1, in which the identifying number of the club is imprinted on said first attachment member.

3. The golf club cover of claim 2, in which said first attachment member includes a rigid disc having a slot formed therein and comprising a flexible strip having one end passing through said slot and another end secured to said body portion, said flexible strip constituting means for flexibly securing said first attachment member to said body portion.

4. A golf club cover arrangement comprising at least two golf club covers, each of said golf club covers including a body portion shaped and adapted to fit over the head of a golf club, a first and a second attachment member secured to said body portion, and first and second mating fastening means respectively secured to said first and second attachment members, whereby one of said fastening means on one of said said first and second attachment members on one golf club cover removed from a golf club can be detachably secured to the mating fastening means on the other of said first and second attachment members of another golf club cover, said first attachment member including a rigid disc having a slot formed therein and comprising a flexible strip having one end passing through said slot and another end secured to said body portion, said flexible strip constituting means for flexibly securing said first attachment member to said body portion.

* * * * *